US009375382B2

(12) United States Patent
Fausti et al.

(10) Patent No.: US 9,375,382 B2
(45) Date of Patent: Jun. 28, 2016

(54) HAND REHABILITATION DEVICE

(75) Inventors: Davide Fausti, Brescia (IT); Carlo Seneci, Brescia (IT)

(73) Assignee: IDROGENET S.r.l., Brescia (IT)

( * ) Notice: Subject to any disclaimer, the term of this patent is extended or adjusted under 35 U.S.C. 154(b) by 767 days.

(21) Appl. No.: 13/634,034

(22) PCT Filed: Mar. 21, 2011

(86) PCT No.: PCT/IT2011/000082

§ 371 (c)(1),
(2), (4) Date: Nov. 19, 2012

(87) PCT Pub. No.: WO2011/117901

PCT Pub. Date: Sep. 29, 2011

(65) Prior Publication Data

US 2013/0072829 A1 Mar. 21, 2013

(30) Foreign Application Priority Data

Mar. 23, 2010 (IT) ..... MI2010A000466
Mar. 10, 2011 (IT) ..... MI2011U000088

(51) Int. Cl.

| | |
|---|---|
| ***A61H 1/02*** | (2006.01) |
| ***A61H 99/00*** | (2006.01) |
| ***A63B 21/00*** | (2006.01) |
| ***A63B 23/16*** | (2006.01) |
| *A63B 21/005* | (2006.01) |
| *A63B 21/008* | (2006.01) |
| *A63B 71/06* | (2006.01) |

(52) U.S. Cl.

CPC ..... *A61H 99/00* (2013.01); *A61H 1/0285* (2013.01); *A61H 1/0288* (2013.01); *A63B 21/00178* (2013.01); *A63B 21/00181* (2013.01); *A63B 21/4019* (2015.10); *A63B 21/4021* (2015.10); *A63B 21/4035* (2015.10); *A63B 23/16* (2013.01); *A61H 2201/0107* (2013.01); *A61H 2201/123* (2013.01); *A61H 2201/1215* (2013.01); *A61H 2201/1246* (2013.01); *A61H2201/149* (2013.01); *A61H 2201/165* (2013.01); *A61H 2201/169* (2013.01); *A61H 2201/1638* (2013.01); *A61H 2201/1697*(2013.01); *A61H 2205/065* (2013.01); *A61H 2205/067* (2013.01); *A63B 21/0058* (2013.01); *A63B 21/0083* (2013.01); *A63B 21/0087* (2013.01); *A63B 71/0622* (2013.01); *A63B 2071/0647* (2013.01)

(58) Field of Classification Search

CPC ..... A61H 1/0285; A61H 1/0288; A61H 2201/1215; A61H 2201/123; A61H 2201/1246; A61H 2201/149; A61H 2201/1638; A61H 2201/165; A61H 2201/169; A61H 2201/1697; A61H 2205/065; A61H 2205/067; A61H 99/00; A61H 21/4035; A61H 21/4019; A61H 21/4021; A63B 21/00178; A63B 21/00181; A63B 21/1438; A63B 21/1442; A63B 21/1469; A63B 21/0058; A63B 21/0083; A63B 21/0087; A63B 23/16; A63B 2071/0647; A63B 21/4035; A63B 21/4019; A63B 21/4021

USPC ..... 601/5, 23, 33, 40; 602/5, 16, 20, 21, 22

See application file for complete search history.

(56) References Cited

U.S. PATENT DOCUMENTS

| | | | | |
|---|---|---|---|---|
| 4,875,469 | A * | 10/1989 | Brook et al. | 601/40 |
| 5,178,137 | A * | 1/1993 | Goor et al. | 601/40 |
| 2003/0073939 | A1 * | 4/2003 | Taylor et al. | 601/40 |

*Primary Examiner* — Quang D Thanh

(74) *Attorney, Agent, or Firm* — Abelman, Frayne & Schwab

(57) ABSTRACT

A hand rehabilitation device is used in rehabilitation therapies, for motility and functionality of the hands. The device has an orthosis, fitted to partially cover a patient's hand and forearm, and flexible rods for a passive and assisted active, concurrent, and/or selective bending or extension of the fingers. Movements are freely settable by an operator. Elements for sliding and supporting of the flexible rods during bending or extension of the fingers include 'finger socks" or gloves provided with thimbles, fixed rods, or plates to stabilize the thimbles and hinged to move the flexible rods. A movement/command and control unit, integral to, or remoted located relative to, the orthosis is provided with actuators for moving the flexible rods. A tension adjusts the rods and rehabilitation device, adjusting and adapting to the hand s anatomical features.

11 Claims, 10 Drawing Sheets

HAND REHABILITATION DEVICE

The present invention relates to a hand rehabilitation device.

More in particular, the present invention relates to a device used in rehabilitation therapies of the motility and functionality of metacarpus-phalanx, proximal interphalanx and distal interphalanx joints, injured or reduced subsequent to traumas, accidents or unfortunate and similar events or in the case of hand paresis or paralysis subsequent to lesions of the central nervous system, spinal cord injuries, injuries of the peripheral nervous system; the same device may be applied in the case of therapies aimed at improving the hand joint motility and functionality, optionally in association with other physiotherapy treatments.

As is known, in the case of damages to the joint tissues subsequent to surgery or traumas or in the case of paralysis for medullary injuries or of the central or peripheral nervous system, the normal functionality of the hand finger joints may be altered if not blocked, with both physical and psychical consequences.

The methods used for treating such pathologies use rehabilitation programs often based on the technique called CPM (Continuous Passive Motion) or passive movement, which may provide the use of motor devices suitable for moving the joints without the individual suffering from the pathology intentionally moving a single muscle.

The advantages of the CPM rehabilitation technique, or passive rehabilitation, consist in that it allows improving the articular range, preventing intra-articular adherences, extra-articular contractures and/or possible injuries resulting from immobilisation and facilitating a quicker return to the joint functionality.

The CPM rehabilitation technique may also be applied subsequent to surgery as it allows preventing the forming of stiffness that may reduce the joint movement. The same technique is applied for treating patients suffering from hemiplegia, as it allows reducing the hand oedema and stimulates the recovery of the motor functions.

Multiple devices have been devised and developed for carrying out rehabilitation therapies for the hand joints with the passive rehabilitation technique or CPM; however, almost all of them are intended for orthopaedic patients.

Some traditional devices, like that object of U.S. Pat. No. 4,875,469, comprise a wrist support provided with a container body wherein there are seated the actuating mechanisms defined by motors and batteries, the control means and the sensors, the device comprises rods or tie rods connected to the patient's hand fingers and to a sliding carriage or guide within the container body. However, such device carries out the passive motion of the hand joints moving a single finger or groups of fingers with the same movement and the same movement/actuation times and excludes the thumb from the treatment; moreover, besides being complex, such device is heavy, limited and difficult to be worn by the patient, since the movement system occupies the palm side of the limb.

U.S. Pat. No. 5,178,137 discloses a dynamic splint which supports and manipulate joints suitable for supporting a finger or other body joint while allowing flexing and extending through the normal joint motion; it comprises a plurality of joint manipulation segments adjacent to each other from a proximal end to a distal end on a joint, means to attach at least one of said plurality of manipulation segments to the joints and means for pivoting said manipulation segments with respect to one another. The means for pivoting the manipulation segments with respect to one another in order to effect the flection and the extension are defined by a cable connected at one end with a motor and with the other opposite end threaded and coupled with a threaded bracket; the motor causes the rotation of the cable and of the threaded end of the same, which rotating inside the threaded bracket causes lengthening or shortening of the cable itself. Said device has drawbacks related to the fact that it does not allow the complete bending of the fingers; this is because the lateral flanges of the joint segments interfere during the finger motion and, during the physiological bending of the fingers, the fingers themselves flank and get closer to each other with the lateral flanges of the joint segments that force the fingers to be separated.

U.S. Pat. No. 5,697,892 describes a rehabilitation device for the hand joints with CPM technique such as to allow a complete bending and extension of the finger joints; such device comprises a base element arranged in the wrist zone fixed to a support stabilised to the forearm, a fixed arm stabilised to the base element and a moving arm hinged relative to the fixed arm, a rotating lever fixed to the moving arm provided with a cross bar whereon fittings are stabilised, which follow the hand finger profile. However, also such embodiment solution implies drawbacks related to the construction complexity, the overall dimensions and the considerable weight and moreover, only allows moving all the fingers at the same time, except for the thumb, which may only be moved separately.

Patent application US2003/0073939 describes a rehabilitation apparatus with CPM technique comprising a movement unit fixed to the forearm and a device for extending/bending the hand fingers fixed to the movement unit; the movement unit comprises a screw device controlled by a motor that allows moving a coupling whereto the resilient elements connected to the hand fingers are connected. Also this type of solution implies drawbacks related to the overall dimensions and to the weights of the structure and moreover, to the impossibility of moving each finger individually and with different types of movements and/or times. The thumb movement is only allowed by mounting a special accessory.

The object of the present invention is to obviate the typical drawbacks of the equipment already existing on the market.

More in particular, the object of the present invention is to provide a rehabilitation device for the hand joints to be used for both the passive rehabilitation or CPM and for assisted active rehabilitation treatments, easy to wear, light and aesthetically neat and such as to be applied to the patient also by a non professional person or not working in the specific field of rehabilitation.

A further object of the present invention is to provide a rehabilitation device which should perform the bending-extension of all the five fingers of the hand or of some of them only, if required by the clinical conditions.

A further object of the present invention is to provide a rehabilitation device highly flexible, modular, reconfigurable and easily adjustable according to the different anatomical features of the patients.

A further object of the present invention is to provide a device that should allow performing a single and/or simultaneous movement of the hand fingers, according to exercises, sequences and combinations freely programmable by the operator.

A further object of the present invention is to provide a rehabilitation device that may be used for rehabilitation treatments also subsequent to traumas or lesions of the central nervous system caused by central nervous system diseases or other pathologies that cause hand paresis or paralysis right from the days immediately subsequent to the acute event, making the rehabilitation intervention earlier.

A further object of the present invention is to provide a rehabilitation device that leaves the hand palm side totally free, so as to not favour the "grasping reflex" that characterises some patients with lesions of the nervous system.

A further object of the present invention is to provide a rehabilitation device which should allow the patient's arm to move or being moved during the therapy and allow the hand to grasp objects and simulate activities of daily living (ADL).

A further object of the invention is to provide a rehabilitation device set up for possible implementations aimed at treating the wrist articulation and/or at integrating position and/or strength sensors.

A further object of the present invention is to provide a motor rehabilitation device suitable for ensuring a high level of resistance and reliability over time and moreover, also such as to be easily and inexpensively constructed.

These and other objects are achieved by the hand rehabilitation device of the present invention that comprises an brace fitted to partially cover the patient's hand and forearm, flexible rods for a passive and assisted active, concurrent and/or selective, bending/extension of the five fingers with exercises, sequences and/or combinations of movements freely settable by the operator, elements for the sliding and supporting of the flexible rods during bending/extension of the fingers, "finger gloves" provided with thimbles, fixed rods or plates stabilised to thimbles and hinged to flexible rods, a movement/command and control unit integral to the brace or remoted located relative to the same, provided with five actuating means for moving the flexible rods, means for adjusting the tension of said rods and means for adjusting and adapting the rehabilitation device to the hand's anatomical features.

The construction and functional features of the hand rehabilitation device of the present invention shall be better understood from the following description, wherein reference is made to the annexed drawings showing a preferred and non-limiting embodiment thereof, and wherein.

Figure 1:
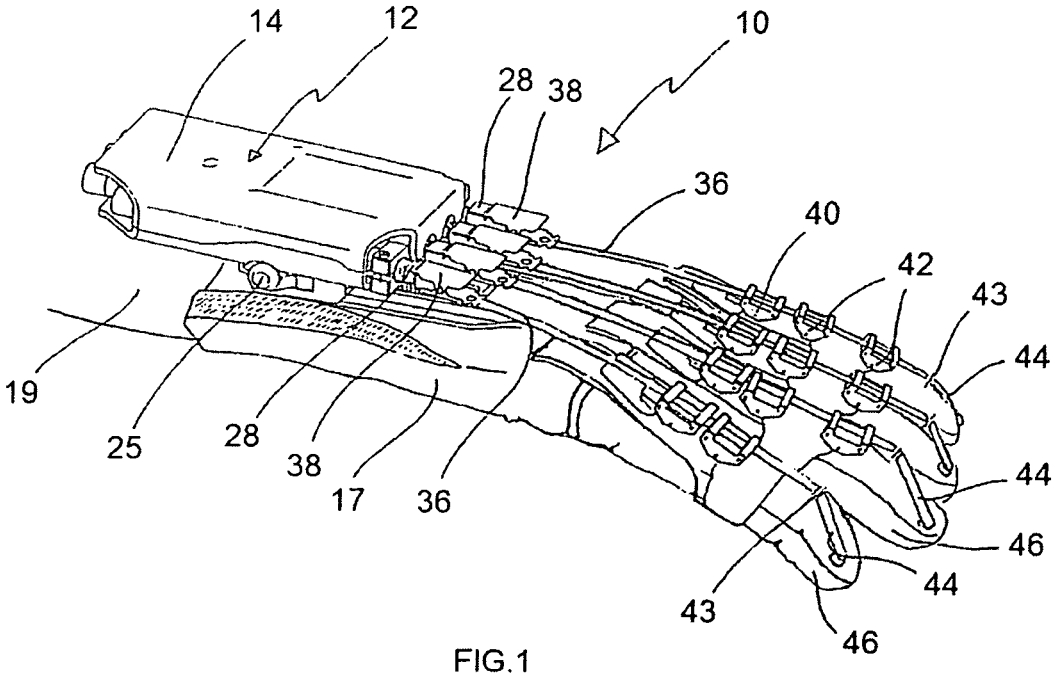
FIG. 1 shows a schematic axonometric view of the hand rehabilitation device of the invention fitted on the hand of the same person.
Figure 2:
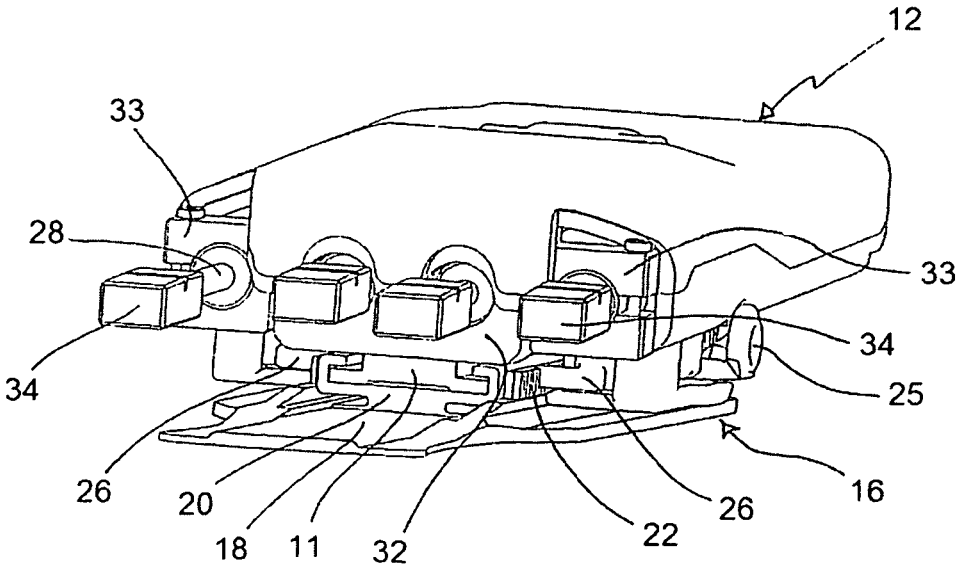
FIG. 2 shows a schematic axonometric view of a component element of the rehabilitation device of the invention.
Figure 3:
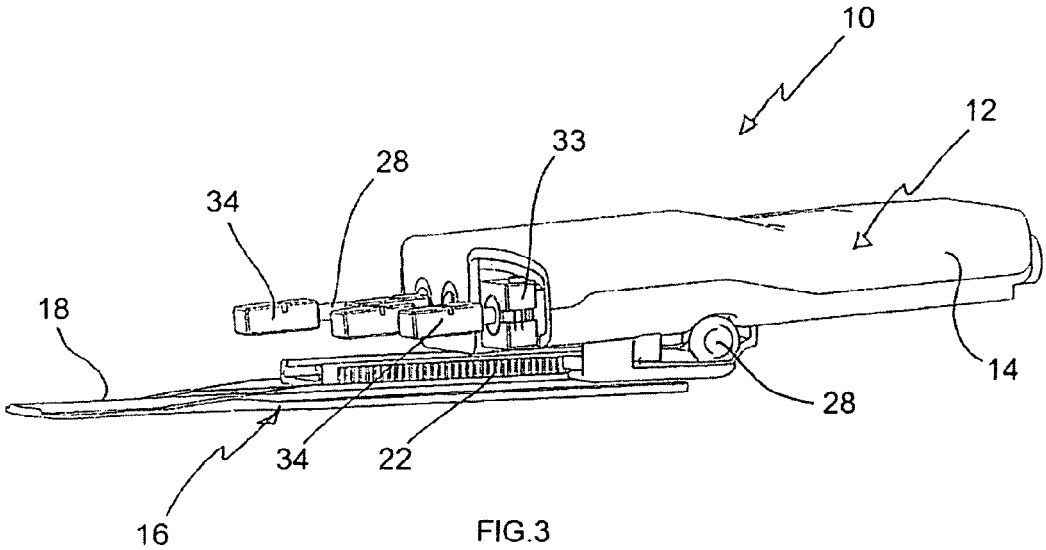
Figure 4:
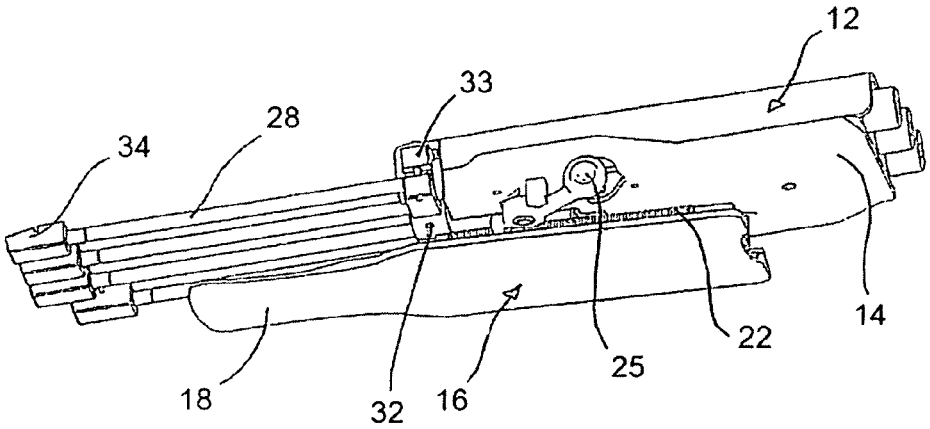
Figure 15:
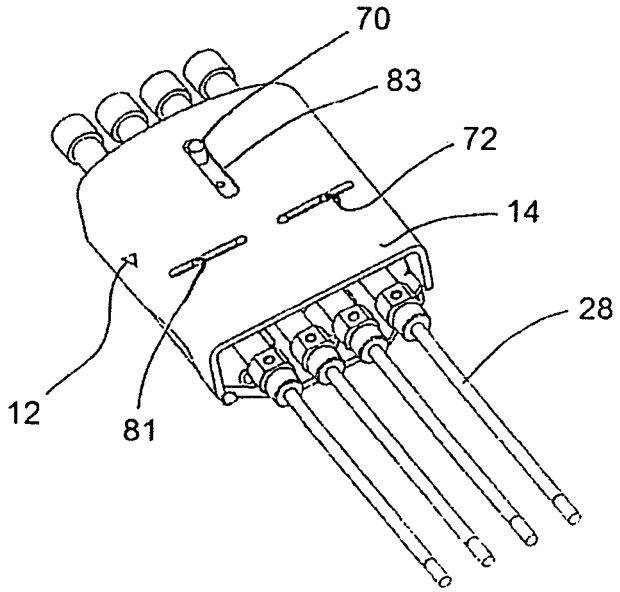
Figure 16:
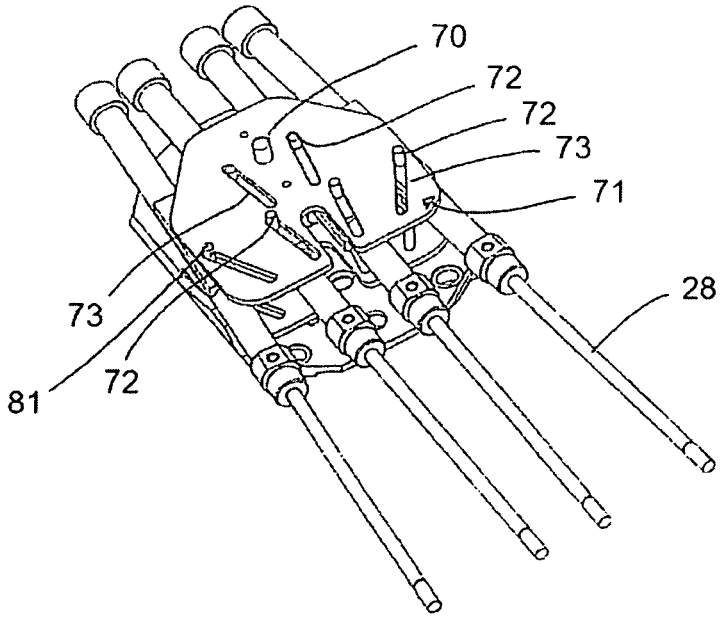
Figure 17:
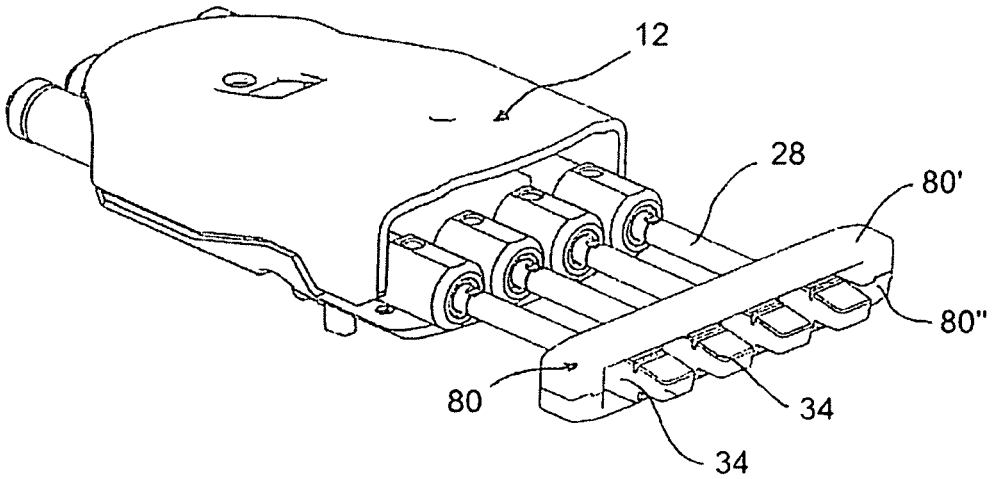
Figure 18:
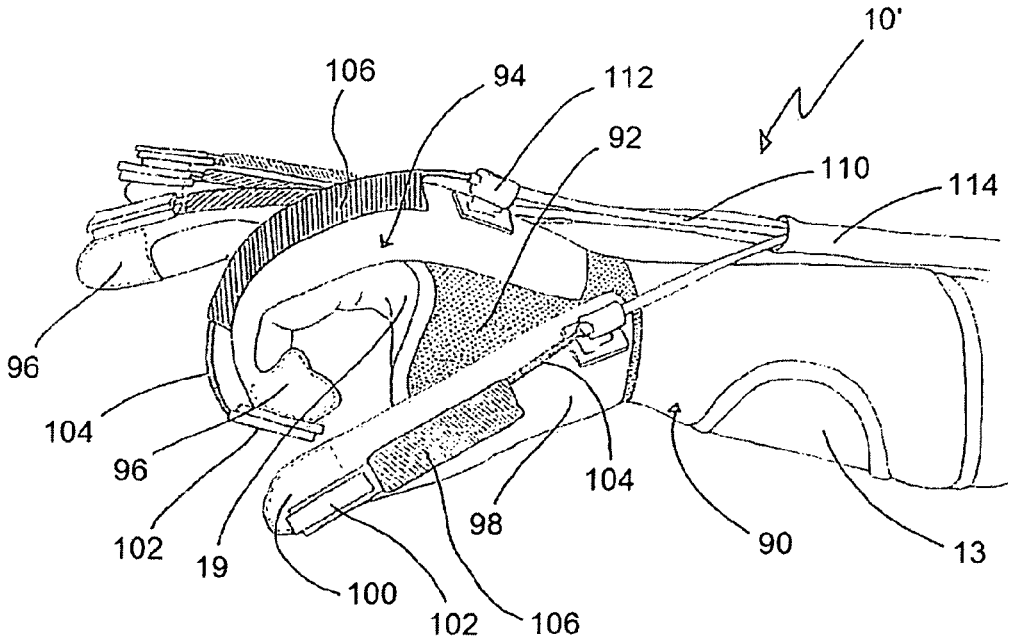
Figure 19:
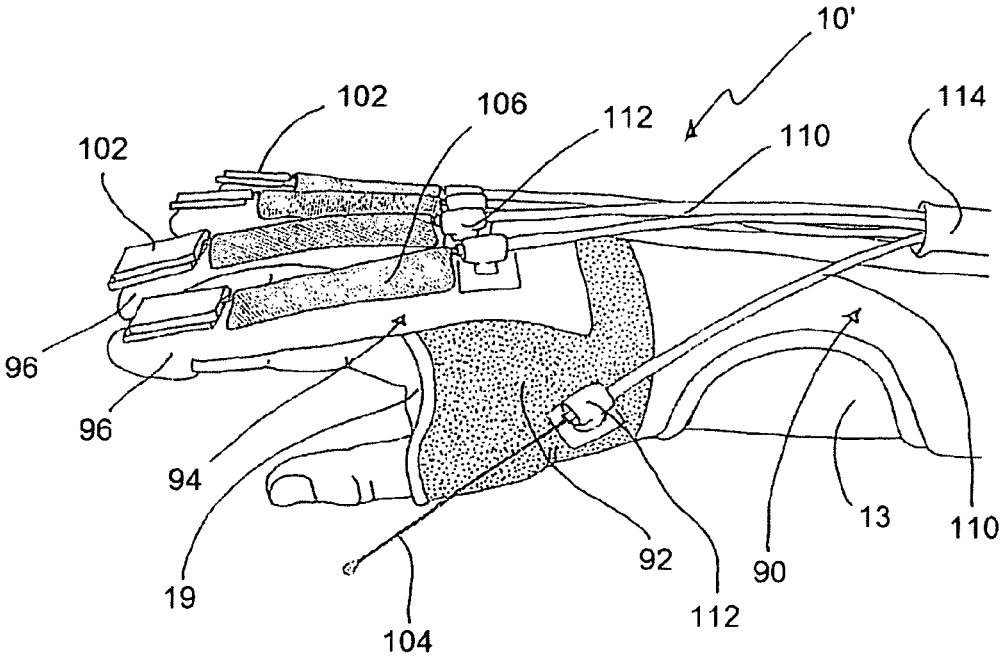
Figure 20:
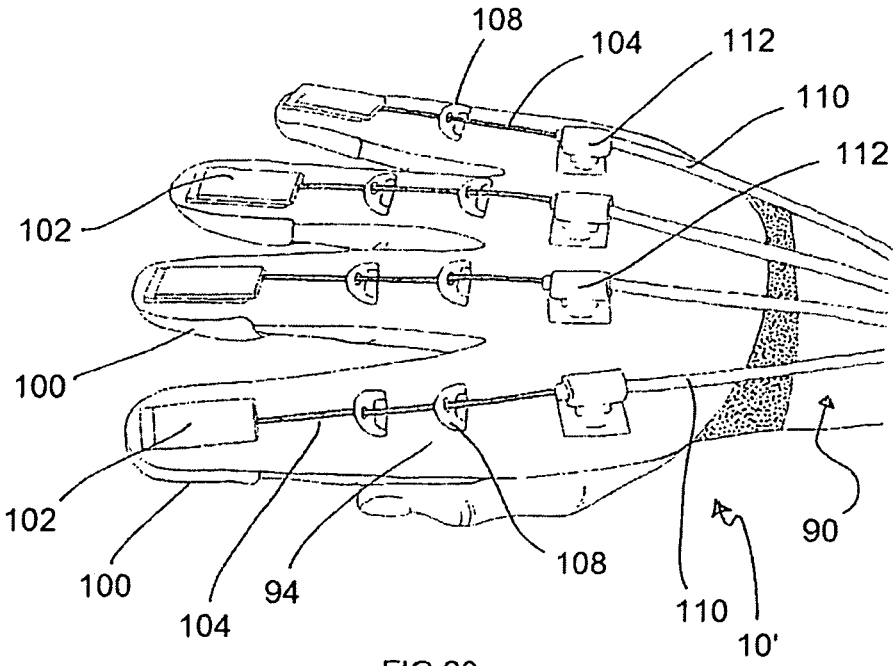
Figure 21:
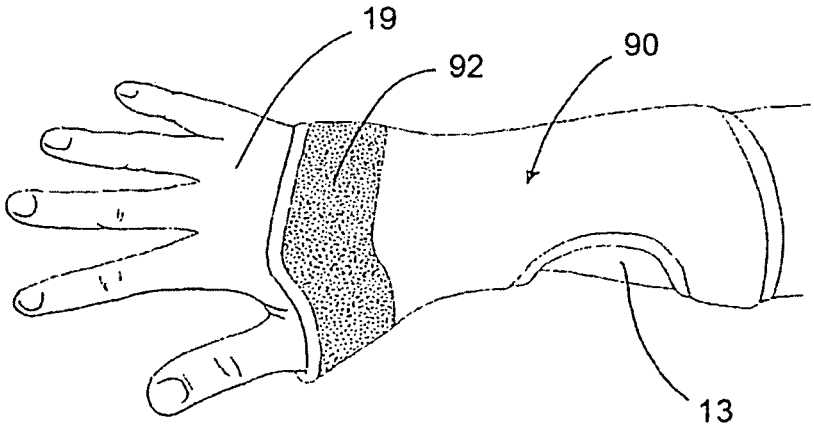
Figure 22:
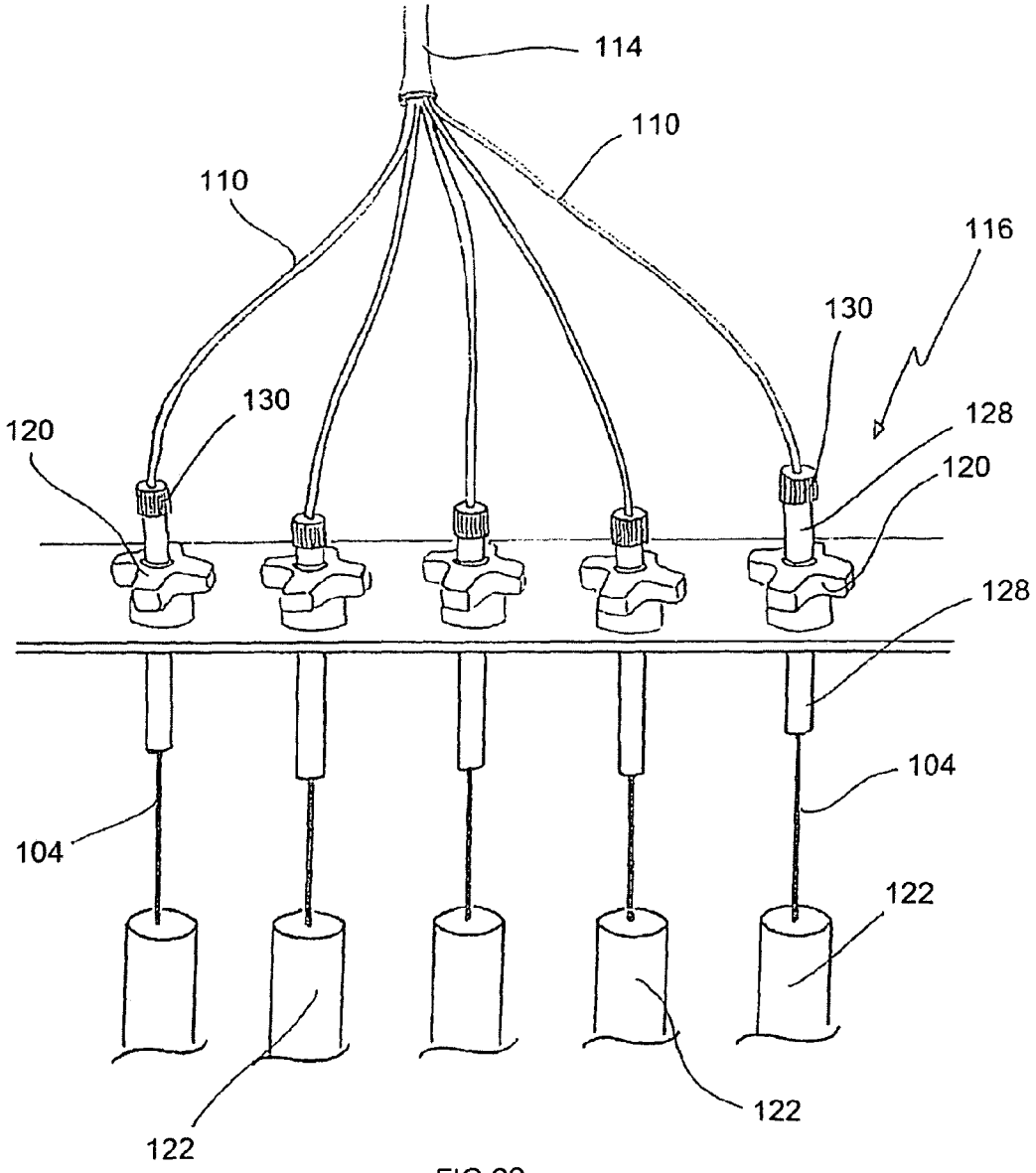

FIGS. 3 and 4 schematically show an axonometric basically side and bottom view of the movement of the component element of the invention according to FIG. 2;

FIGS. 5, 6 and 15, 16 schematically show a top view of the movement of further component elements of the rehabilitation device of the invention;

FIGS. 7 to 10 schematically show side views of the movement sequences of some joints of the hand fitted with the rehabilitation device of the invention;

FIGS. 11 to 14 schematically show the steps of application and connection of the rehabilitation device of the invention;

FIGS. 15 and 16 schematically show an axonometric view of a component of the device of the invention;

FIG. 17 shows a schematic axonometric view of the device of the invention provided with an optional and accessory element;

FIG. 18 shows a schematic side view of the rehabilitation device according to an alternative embodiment and in a configuration with a bent finger;

FIG. 19 shows a schematic view of the device according to FIG. 18 in a configuration with extended fingers;

FIG. 20 shows a schematic top view of the rehabilitation device according to an alternative embodiment;

FIG. 21 shows a schematic view of a component detail of the device of the invention according to the alternative embodiment;

FIG. 22 shows the schematic view of a device for adjusting the tension of the flexible rods according to a preferred and non limiting embodiment of the device according to the alternative embodiment.

With particular reference to FIGS. 1 to 17, the hand rehabilitation device, globally indicated with reference numeral 10, comprises a movement or control device 12 consisting of a container body 14, made of metal or plastic material or otherwise known, wherein there are seated the movement means or components that shall be described in detail hereinafter.

The box body 14 is slidingly arranged relative to a guiding element 16 located at the bottom of the same box body and comprising a plate shaped element 18 on the top front whereof, facing the direction of the bottom surface of the box body 14, there is formed a linear guide 20, with "C" section, open on the top front facing the direction of the box body 14 and on the outer side faces whereof there is formed a rack or knurled surface 22 substantially extended by the entire length of the same guide 20. The guiding element 16 is integral to a brace 17 whereto it is fixed by a hook and loop fastener, for example, the type marketed under the trademark Velcro, or other type of coupling. The brace 17 is fitted on hand 19 of the patient or user and covers the wrist and a part of the forearm as indicated in FIGS. 1 and 9 to 14. Said brace 17 is defined by a finger glove of fabric or other suitable transpiring and anallergic material, wound on the hand and part of the forearm of the patient or device user and closed by a zip fastener 15, buckles 21, a hook and loop fastener 23 or the like. Brace 17 can optionally surround the thumb too, as schematised in FIGS. 9 to 14. The palm portion of the brace 17 is preferably stiffened by a stick of non deformable material, suitable for imparting stability and supporting the patient or user's hand.

A carriage 11 is firmly applied to the bottom front of the box body 14 which, upon installation, slidingly engages in the linear guide 20. At least one button 25, located at the side of the box body 14, allows locking/releasing the movement or control device 12 relative to the guiding element 16; this takes place, for example, by means of a wedge cooperating with an elastic element and suitable for engaging with the rack or knurled surface 22. The sliding mode of the movement or control device 12 relative to the guiding element 16 therefore allows adjusting the position of said movement device according to the anatomical features of the user or patient's hand that wears the device of the invention. Within the box body 14 of the movement or control device 12 there are arranged four actuators 28 of the linear type at the forefinger, middle finger, ring finger and little finger of the hand; the thumb is provided with a separate and dedicated actuation means that shall be described in detail hereinafter. Actuators 28 may all be located on the same plane, as shown in FIG. 2, or as an alternative they may be located on different planes; in particular, the actuators relating to the forefinger and to the little finger may be in a lower position than the actuators relating to the middle finger and to the ring finger.

Actuators 28 are basically provided with pushing stems. Such stems are sliding relative to clamping blocks 32 and 33 arranged at the forefinger, middle finger, ring finger and little finger; in particular, the clamping block 32 is arranged at the actuators of the ring finger and middle finger whereas the clamping blocks 33 are arranged at the little finger and forefinger.

Figure 5:
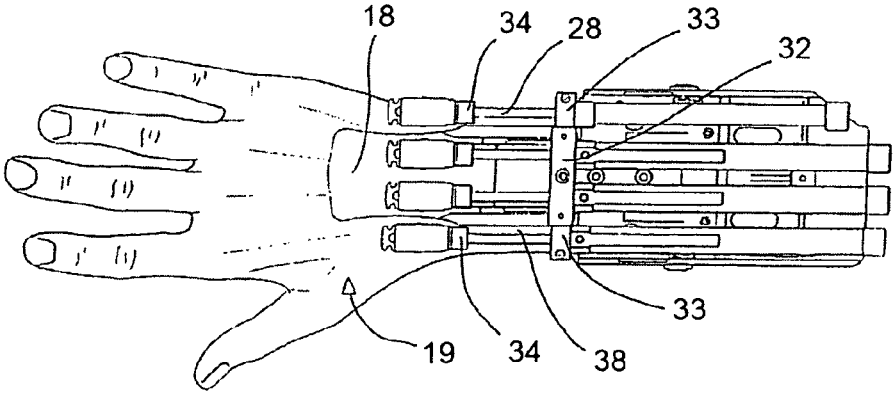
Figure 6:
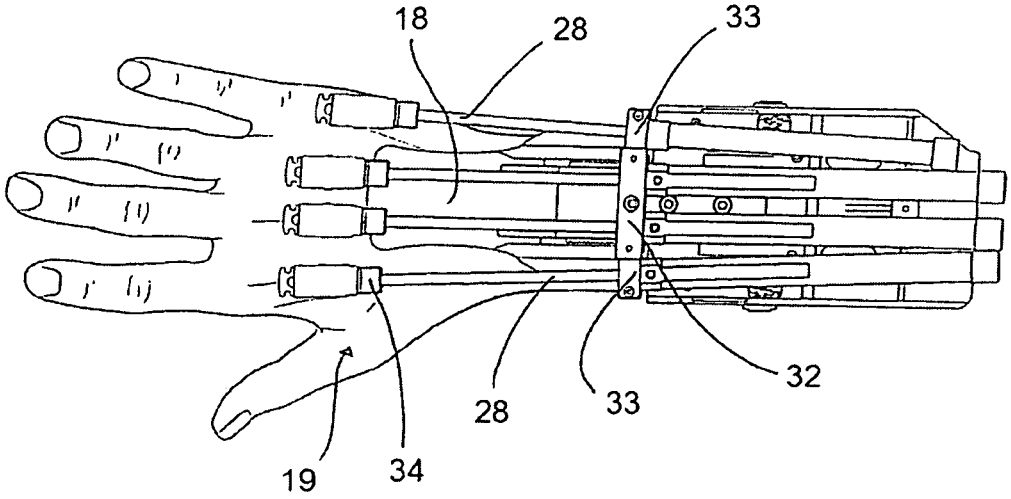
Figure 7:
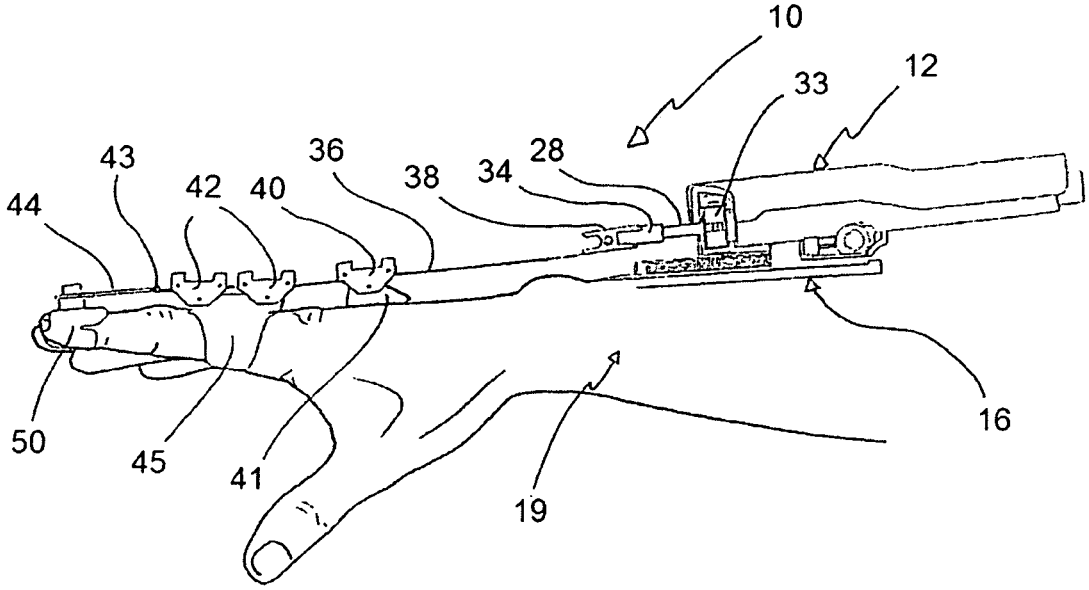
Figure 8:
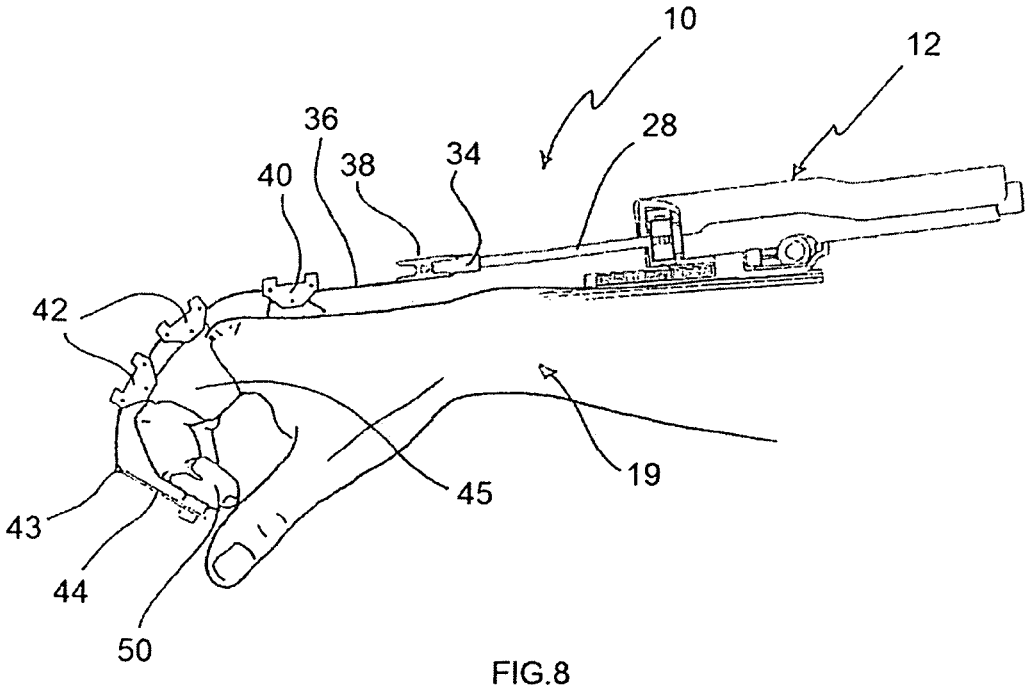

With particular reference to FIGS. 5 and 6, the clamping blocks 33 are opposite to one another and hinged to the clamping block 32 at the ends; in this way, the two outer actuators are capable of changing the relative angular position, with angles larger than 0°, thus favouring the adjustment to the patient's hand configuration.

As an alternative, the movement or control device 12 may have the configuration described in FIGS. 15 and 16 wherein the user can generate the opening, on the horizontal plane, of actuators 28 by the actuation of a manual control or lever 70 projecting relative to the top surface of a plate 71. The mechanism inside the box body 14 actuated by the manual control or lever 70 forces pins 72, fixed to actuators 28, to slide relative to slots 73 formed on plate 71. Further slots 81 and 83, made on the box body 14, allow the sliding of the manual lever 70 and of pins 72 relative to the same box body. The two central cylinders are separated remaining parallel to each other, whereas the outer cylinders are spread apart. Also in this configuration, the two outer actuators maintain the possibility of changing the relative angular position, with angles larger than 0°, favouring the adjustment to the patient's hand configuration.

At the free end of the stem of each actuator 28 there is fixed a coupling block 34 for connecting the motion transmission means that shall be described hereinafter.

Actuators 28 may be of a different type, such as for example electrical, rotating, screw transmission, pneumatic, hydraulic or hybrid.

The means for transmitting the motion to the hand fingers of the user of the device of the invention are schematised in FIGS. 1, 7, 8, 11 and 12; with reference to said figures, there is described the transmission means relating to a single finger selected from forefinger, middle finger, ring finger and little finger, the transmission means for the thumb joints are object of description hereinafter. According to a preferred and non limiting embodiment configuration, schematised in said figures, the transmission means comprise a flexible rod 36 made of a metal, plastic material or other suitable material with elastic properties the end whereof facing the direction of the movement or control device 12 is provided with a quick coupling system 38 suitable for engaging with the coupling block 34 of the same movement device; the coupling between the quick coupling system 38 and the coupling block 34 may be of the fitting type or other known type. The coupling block 34 may be configured so as to allow a precise adjustment of the extension of the portion of flexible rod 36 subject to the pushing action of the stem of actuators 28. The flexible rod 36 is sliding relative to a sliding block or loop 40 arranged at the metacarpus and at at least a further sliding block or loop 42 arranged at the first phalanx. Such sliding block or loop 40 and further sliding block or loop 42 may be internally provided with rollers or be made of a low friction material, so as to facilitate the sliding of the flexible rod 36. The sliding block or loop 40 and the further sliding block or loop 42 are respectively hinged relative to a support 41 and to a ring 45 and fixed, by a hook and loop fastener, such as marketed under the trademark Velcro, or sewing or the like, to a "finger glove" 46 made of fabric or other material suitable for the purpose, fitted on the user or patient's fingers and fixed to the brace 17 by hook and loop fastener strips or other known stabilisation types, as shown schematically in FIGS. 11 and 12. The end of the "finger glove" 46 exhibits a stiff or elastic thimble 50, optionally internally padded with material suitable for ensuring the comfort of the patient's distal phalanx. The "finger glove" 46, as an alternative, may be relieved of the bottom portion of the fabric at the phalanxes, keeping thimble 50, ring 45 and support 41 with the respective sliding blocks or loops 42 and 40. Ring 45 may be made so as to be adjusted (tightened or loosened) according to the dimensions of the patient or user's fingers ensuring the utmost adherence thereof. The means for transmitting the motion to the hand finger also comprise a stiff rod 44, made of metal, plastic or other suitable material, constrained on one side to the end of the flexible rod 36 by a hinge 43 and on the other side stiffly to thimble 50. The articulation between the flexible rod 36 and the stiff rod 44, defined by the coupling between one end of the flexible rod 36 and the stiff rod 44, allows an adequate rotation between the same allowing the complete bending of the hand finger joints.

Figure 9:
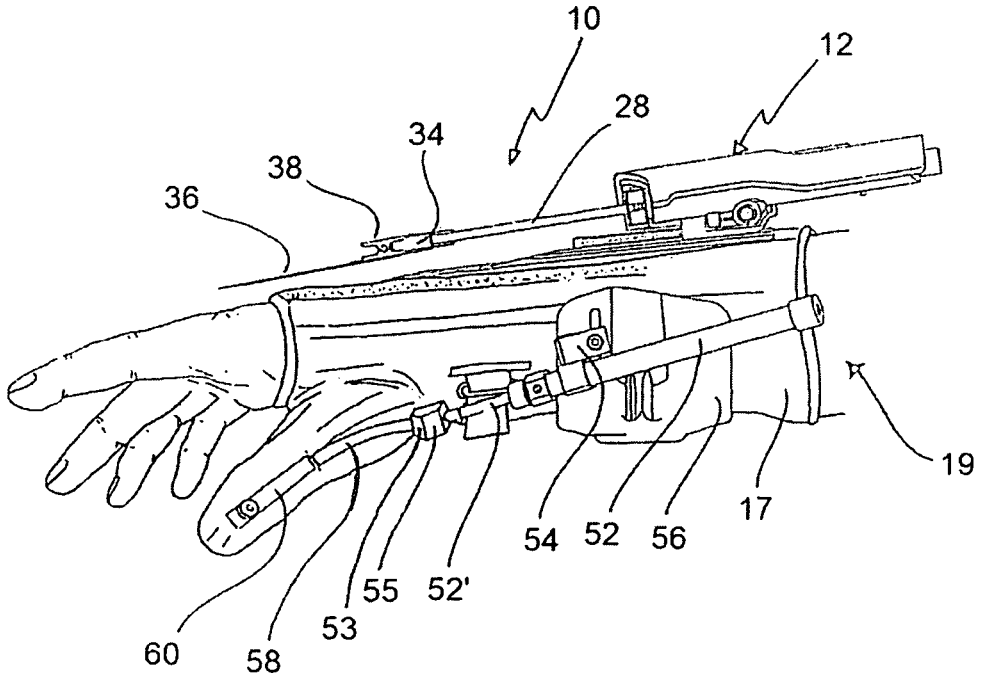
Figure 10:
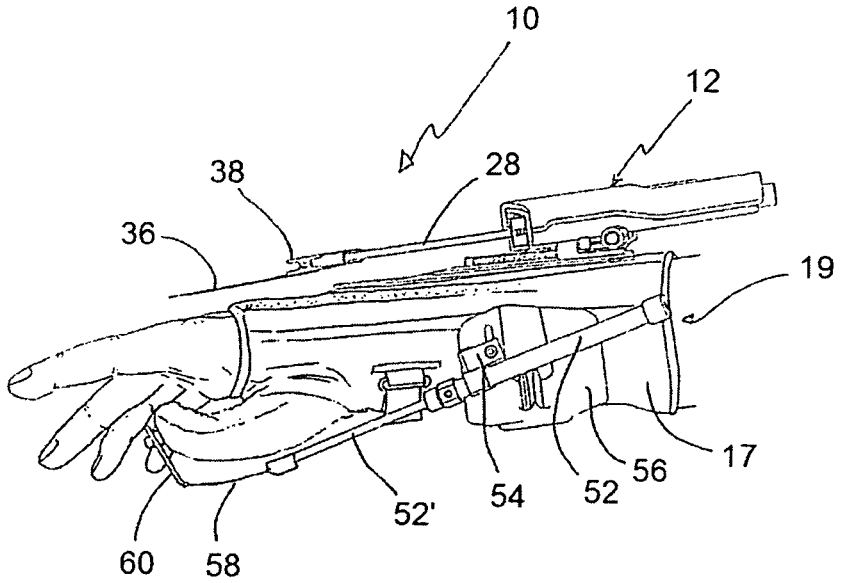
Figure 11:
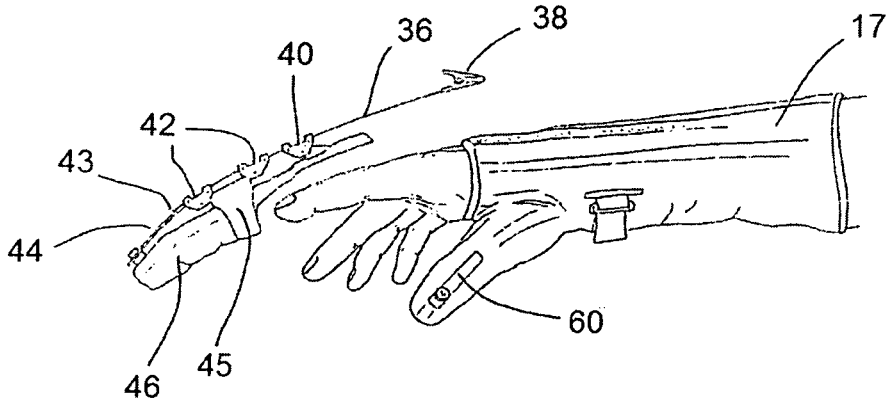
Figure 12:
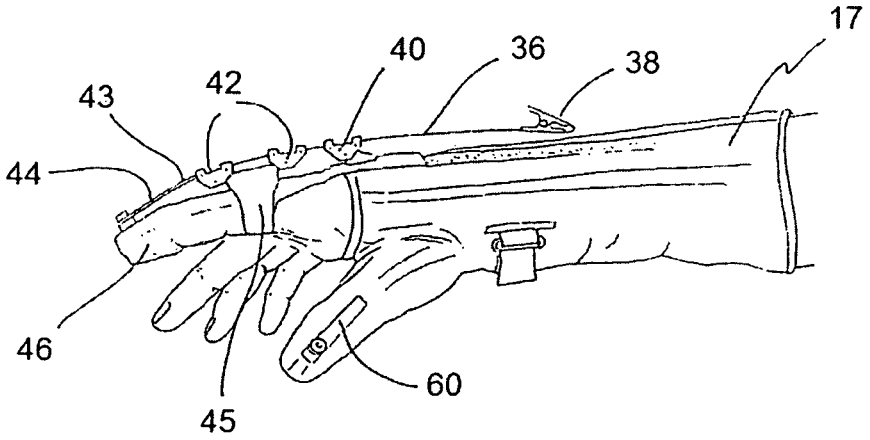
Figure 13:
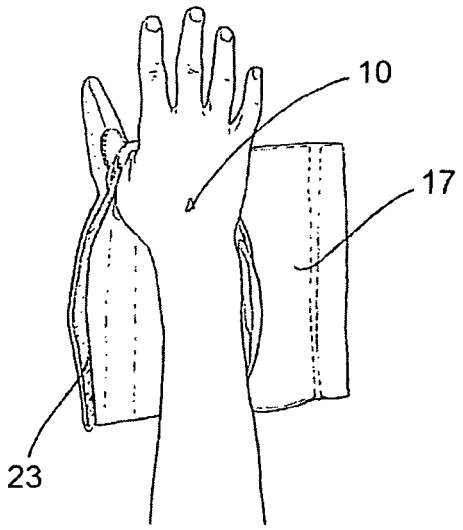
Figure 14:
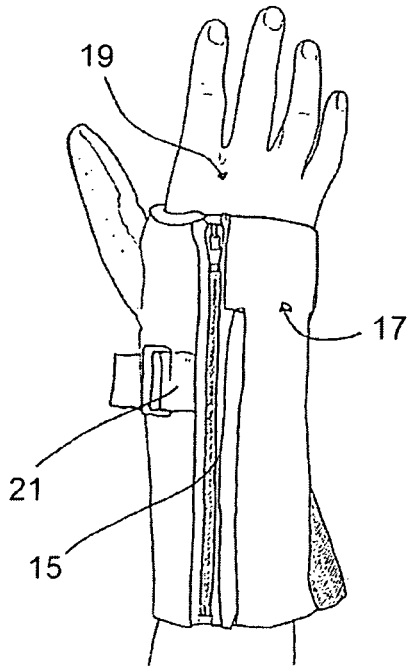

With reference to FIGS. 9 and 10 there are described the means suitable for realising the motion transmission system to the hand thumb joints. Said means comprise a linear actuator 52 constrained relative to a support 54 hinged relative to a support 56 integrally fixed to the brace 17; support 54 allows adjusting both the linear position of the linear actuator 52 so as to adjust it to the morphological features of the user's thumb, and the angular position for keeping into account the variations that occur during the movement of the joints of the same thumb. Similar to what described with reference to other fingers, a clamping block 53 of stem 52' of the linear actuator 52 is fixed, by means of a quick coupling system 55, to a flexible rod 58 at the end whereof, opposite that of fixing relative to stem 52', is hinged to a fixed rod 60; the end of the fixed rod 60, opposite that of connection with the flexible rod 58, is constrained to the thimble that covers the thumb.

The clamping block 55 is configured so as to allow a precise adjustment of the extension of the portion of flexible rod (comprised between the clamping block and the hinge) subject to the action of the actuators.

The thumb mobilisation system described above is connected to a "finger glove" suitable for the thumb, which may be fully integrated to the brace 17 or independent and similar to the coatings of the other fingers.

The device of the invention, moreover, is provided with an optional and accessory element 80, shown in FIG. 17 and consisting of two sub-elements 80' and 80" shaped as a "U" arranged opposite one on top of the other; the accessory element 80 thus defined and arranged on the coupling blocks 34 allows making the actuators of the forefinger, middle finger, ring finger and little finger integral in the linear motion thereof.

To use the motor rehabilitation device of the invention, the patient shall first wear the brace 17, stabilise the means for the thumb joints and for the joints of the other hand fingers through fixing relative to the brace and to the coupling blocks 34 and make the connections for actuating actuators 28. Subsequently, the device is actuated by a control sent to actuators 28 and the hand finger movement takes place as schematised in FIGS. 7 and 8. Under the pushing action of the linear actuators, the flexible rod tends to bend causing the closing movement of the hand fingers and at the same time, the same causes a push action on the stiff rod that leads to the bending of the distal phalanx of the fingers. The number of repetitions made by the hand fingers, their duration and the movement method vary according to specific protocols formulated based on the features of the patient or user subject to the assisted active or passive motor rehabilitation treatment.

With reference to FIGS. 18 to 22, there is shown an alternative embodiment of the rehabilitation device, globally indicated with reference numeral 10', comprises a brace 90 defined by a glove made of fabric or other transpiring and anallergic and/or elastic material fitted to partly cover hand 19 and forearm 13 of the patient user of the device stabilised by buckles or hook and loop fasteners, bands/strips, zip fasteners and the like.

At the end of said brace 90 arranged in the direction of the patient's hand 19 there is a portion or strip 92 of adhesive fabric of the hook and loop fastener type suitable for allowing the fixing of a finger glove 94 internally provided or integrating, as a single body therewith, thimbles 96 to be fitted on the end phalanx of forefinger, middle finger, ring finger and little finger of the hand; in a further alternative embodiment, the device of the invention is provided with four finger gloves 94, one for the forefinger, one for the middle finger, one for the ring finger, one for the little finger.

A further finger glove 98 provided with a further thimble 100 is fixed to strip 92 at the thumb joint with the further thimble 100, inserted internally or obtained in a single body with the further finger glove 98, fitted on the second phalanx or end of the thumb; in an alternative embodiment, finger glove 94 and the further finger glove 98 may be defined by a single piece.

In a further alternative embodiment, brace 90 and finger gloves 94 and 98 may be defined by a single piece.

At each thimble 96 of finger glove 94 and of the further thimble 100 of the further finger glove 98 there is stabilised, by gluing, sewing or other known type of fixing, a plate 102 at an end whereof there is hinged, with a quick coupling mechanism, a flexible rod 104 sliding relative to a loop 106 fixed, glued or made in a single piece with finger glove 94 and with the further finger glove 98 of the thumb. The articulation between the flexible rod 104 and plate 102, defined by the coupling between an end of the flexible rod 104 and plate 102, allows an adequate rotation between the same allowing the complete bending of the hand fingers.

Said loop 106 is made of elastic fabric or other suitable flexible material suitable for allowing the sliding of the flexible rod 104 with a minimum or even null friction value.

In an alternative configuration, schematised in FIG. 20, each rod 104 is sliding, besides supported, relative to at least one buckle 108 positioned on the back of each of the hand fingers and fixed to finger glove 94 and to the further finger glove 98; said at least one buckle 108 is made of a metal, plastic, carbon fibre, glass material or other suitable material suitable for allowing the sliding of the flexible rod 104 with a minimum or even null friction value.

A further alternative configuration provides a concurrent presence of loop 106 and of at least one buckle 108 for each finger; said buckle 108 may be positioned within loop 106.

Each flexible rod 104, moreover, slides within a sheath 110 the end whereof facing the direction of the fingers of hand 19 is stabilised relative to a sleeve 112 fixed to finger glove 94 and to the further finger glove 98. Said sheath 110 is of metal, plastic, carbon fibre, glass material or other suitable flexible material suitable for allowing the sliding of the flexible rod 104 with a minimum or even null friction value.

The flexible rods 104 that slide within sheaths 110 are gathered in a protective sheath 114 and connected to a remote control unit 116 wherein there are seated five actuators that allow slidingly moving the flexible rods 104 so as to allow the bending/extension movement of the joints of the fingers of hand 19.

The end of sheaths 110 facing the direction of the remote control unit is provided with an adjustment system that modifies the relative position of each sheath 110 relative to the flexible rod 104. Before starting the device, said adjustment system allows bringing manually the patient's fingers to the desired starting position, according to the rehabilitation protocols and to the patient's anatomical and clinical features.

A preferred and non limiting embodiment of said adjustment system is shown in FIG. 22, wherein sheaths 110 (wherein the flexible rods 104 slide) are fixed relative to clamps or handles 120 coaxial relative to stems 122 of the actuators and turnably arranged relative to a plane of the control unit. In particular, the connection of sheaths 110 with clamps 120 takes place by means of stiff sectors 128 axially sliding relative to clamps 120 and provided with a knurled end 130. By releasing or screwing a clamp 120 it is possible to loose or increase the grip thereof on the stiff sector 128 sheath 110 is connected to, allowing properly acting with the fingers on the knurled head 130 of the stiff sector 128, causing the axial sliding thereof, for adjusting the relative length of sheath 110 in relation to the inner flexible rod 104 (connected to stem 122 of the actuator), obtaining a stronger or weaker tension of the same.

The use of the hand rehabilitation device described above in detail with reference to the construction features thereof is detailed hereinafter.

Before assembling or arranging the device relative to the patient's hand, it is necessary to select a suitable size of brace 90, of finger gloves 94 and 98 and of thimbles 96 and 100. Brace 90, finger gloves 94 and 98 and thimbles 96 and 100 may in fact be made in different sizes so as to ensure the maximum adherence to the anatomical features of the patient's hand.

Thimbles 96 and 100, whereto plates 102 are fixed, may also be extracted from finger gloves 94 and 98 and replaced with the thimbles suitable for containing the last phalanx of the patient's fingers.

Before performing the rehabilitation it is necessary to fit brace 90 on the patient's forearm and wrist, fit finger glove(s) 94 and the further finger glove 98 on the hand fingers and fix them relative to the same brace, adjusting the position thereof according to the anatomical features of the fingers, insert the flexible rods 104 into loops 106 and/or into buckles 108, connect the flexible rods 104 to plates 102 and stabilise sheaths 110 to sleeves 112.

As an alternative, the device may also be assembled according to the following sequence of activities: fit brace 90 on the patient's forearm and wrist, insert the flexible rods 104 into loops 106 and/or into buckles 108, connect the flexible rods 104 to plates 102, fit the finger glove(s) 94 and 98 on the hand fingers and fix them relative to the finger glovebrace 90 adjusting the position thereof according to the anatomical features of the fingers, stabilise sheaths 110 to sleeves 112.

Before actuating the device it is appropriate to manually move the patient's fingers to the desired starting position, changing the tension of the flexible rods 104 through the adjustment system of the relative position of each sheath 110 relative to the flexible rod 104 that slides therein.

Subsequently, the device is actuated through the control unit that forces the bending/extension of the flexible rods according to the methods defined by the different rehabilitation protocols, causing a bending/extension action of the phalanxes of the patient's fingers.

The device allows actuating a mobilisation of the fingers or groups of fingers of the hand in a sequential or synchronous manner, according to exercises, sequences and combinations that are freely programmable by the operator. The device allows excluding one finger or more fingers from the exercise, changing the execution speed, defining the order of movements, diversifying the angular range between each finger, setting any pauses in bending or extension, determining the number of repetitions of the bending-extension cycles.

The device of the invention may be provided with power and/or force sensors so as to have a feedback for the activation of the actuators and the adjustment of the movement according to the spontaneous articular responses of the patient during the rehabilitation session and for measuring the strengths applied by the patient during the exercise.

A management and control software provided with a graphical interface for displaying simulations of the movement to be performed or being performed, allows the patient and the physiotherapist to view the movement pattern and monitor it; in this way it is possible to have a preventive and simultaneous display of the movements executed. Moreover, the association of sound and visual feedbacks to the movements allows stimulating the patient's neuro-cognitive recovery.

As is clear from the description above, the advantages achieved by the device of the invention, described in detail hereinabove with reference to its components and its preferred and non limiting embodiments, are clear.

The hand rehabilitation device of the present invention exhibits the advantage of being light and modular, besides being easy and quick to wear; this also allows the use thereof without the strict presence of the physiotherapist or other medical staff.

The flexibility of the mechanical components of the device, along with the flexibility of the control software and with the graphical simulation of the movement allow implementing customised therapies by doctors or physiotherapists, for treating the specific disabilities of different types of patients, including those bedridden and those with flabby upper limb.

The hand rehabilitation device of the present invention ensures a low impedance to a voluntary movement of the patient and can therefore be advantageously used for both assisted active and passive mobilisation treatments; in fact, the device of the invention allows imposing the movement to the finger joints and it also allows the patient to spontaneously move the same, making the actuators intervene only in some steps of the movement or when predetermined conditions occur.

A further advantage of the rehabilitation device is represented by the fact that it allows the concurrent and/or single mobilisation in bending/extension of the fingers, according to exercises, sequences, and combinations freely settable by the operator that can exclude one or more fingers from the exercise, vary the execution speed, define the movement order, diversify the angular range for each finger, set any pauses in bending or extension, determine the number of repetitions of the bending-extension cycles.

A further advantage of the rehabilitation device of the invention is represented by the fact that it leaves the hand palm side totally free, so as o favour the grasping reflex that characterises some patients with injuries of the nervous system.

The rehabilitation device of the invention also has the advantage of allowing the patient's arm to move or be moved during the therapy and allow the hand to grasp objects and simulate Activities of Daily Living (ADL), essential in the neuro-motor recovery.

While the invention has been described above with particular reference to two exemplary and non limiting embodiments thereof, several changes and versions will appear clear to a man skilled in the art in the light of the above description. The present invention therefore includes all the changes and versions that fall within the spirit and scope of the following claims.

The invention claimed is:

1. A hand rehabilitation device, for rehabilitating motility and functionality of metacarpus-phalanx, proximal interphalanx and distal interphalanx joints which are injured or reduced subsequent to a trauma, in a post-surgery period, or in the case of hand paresis or paralysis subsequent to central nervous system diseases, spinal cord injuries, peripheral neuropathies, and for improving the hand joint movements in association with a physiotherapist's treatment during rehabilitation sessions, said rehabilitation device comprising:

an orthosis adapted to be fitted to partially cover a user's hand and forearm;

flexible rods for a passive and assisted active, concurrent and/or selective, bending/extension of the user's five fingers with exercises, sequences and/or combinations of movements freely settable by the user;

elements for sliding and supporting of the flexible rods during bending/extension of the fingers;

"finger socks" or bands provided with thimbles, fixed rods or plates stabilized to thimbles and hinged to flexible rods;

a movement/command and control unit integral to the orthosis or remoted located relative to the orthosis;

five actuators for moving the flexible rods;

means for adjusting the tension of said flexible rods; and means for adjusting and adapting the rehabilitation device to the hand's anatomical features.

2. The rehabilitation device according to claim 1, wherein the flexible rods comprising fingers flexible rods and a thumb flexible rod; each finger rod adapted to fit and move joints of forefinger, middle finger, ring finger and little finger and the thumb flexible rod adapted to fit and move a thumb joints, wherein each of the flexible rods having an end provided with a first quick coupling system relative to one of the actuators and other end hinged respectively relative to one of the fixed rods, the end whereof opposite that of connection to one of the flexible rods is constrained to a stiff or elastic thimble which is padded with material suitable for ensuring the comfort of the user's distal phalanxes, said finger flexible rods placed relative to the elements for the sliding and supporting defined by a block or first sliding loop arranged at the metacarpus joint and by at least one further block or second sliding loop arranged at a first phalanx, with said block or first sliding loop and said further block or second sliding loop internally provided with rollers or made of a low friction material and respectively hinged relative to a support and to an adjustable ring fixed by a hook and loop fastener or sewing, on the "finger sock" made of fabric or other material adapted to be fitted on the user's fingers by the thimbles and fixed to the orthosis.

3. The rehabilitation device according to the claim 2, wherein the first quick coupling system of each finger flexible rod engages with a coupling block of an actuator arranged inside the movement/command and control unit, and a second quick coupling system of the thumb flexible rod engages with a coupling block of a linear actuator constrained relative to a support hinged to another support integrally fixed to the orthosis.

4. The rehabilitation device according to claim 2, wherein the movement/command and control unit, placed over the orthosis, comprises a box body slidingly arranged relative to the means for adjusting and adapting the rehabilitation device, defined by a guiding element located at a bottom of said box body and by a carriage integral with the box body, provided with a mechanical stop defined by a button located at one side of the box body for locking/releasing of a movement of the control device relative to the guiding element; wherein said guiding element comprising a plate shaped element on a top front whereof, facing a bottom surface direction of the box body, and a linear guide having outer side faces containing a rack or knurled surface substantially extended by an entire length of the linear guide.

5. The rehabilitation device according to claim 4, wherein the actuators are one of the types consisting of an electric, rotating, screw transmission, pneumatic, hydraulic and hybrid type, and arranged inside the box body; said actuators being arranged on different levels in which actuators relating to the forefinger and little finger are in lower position than the actuators relating to the middle finger and to the ring finger, and wherein an angular position of the actuators is variable in opening according to a horizontal plane by means of two first clamping blocks and of one second clamping block opposite to one another and hinged to the ends of the second clamping block placed at the middle and ring fingers; and wherein the movement/command and control unit comprising a plate having a top surface provided with a manual control or lever, pins fixed to the actuators and slidable relative to slots disposed on the plate and with further slots disposed on the box body and respectively suitable for allowing the sliding of the pins and of the manual lever relative to the box body.

6. The rehabilitation device according claim 3, further comprising an accessory element consisting of two sub-elements each having U-shaped and arranged opposite one on top of the other, said accessory element arranged over the coupling blocks is suitable for allowing linear motion of a forefinger, middle finger, ring finger and little finger.

7. The rehabilitation device according to claim 1, wherein each the flexible rods having an end hinged relative to a third quick coupling mechanism defined by the plates stabilized by first thimbles for the forefinger, middle finger, ring finger and little finger joint, and to a second thimble for the thumb joint, said first and second thimbles respectively inserted or integrated into one or more first gloves and a second glove adapted to be fitted on the hand fingers and fixed to the orthosis by a portion or strip of a hook and loop fastener, and wherein the flexible rods are slidable relative to the elements for sliding and supporting defined by loops and/or buckles fixed relative to the first gloves and to the second glove, wherein each of the flexible rods further being slidable within sheaths stabilized relative to sleeves, stabilized relative to the first gloves and to the second glove and all flexible rods are gathered in a protective sheath.

8. The rehabilitation device according to claim 1, wherein the means for adjusting the tension of each of the flexible rods including a movement/command and control unit placed in a remote position relative to the orthosis and are defined by clamps or handles coaxially relative to stems of the actuators, and by stiff sectors axially sliding relative to the clamps, said stiff sectors being provided with a knurled end and connected with sheaths inside which are slidingly arranged the flexible rods connected to the stems of the actuators.

9. The rehabilitation device according to claim 7, wherein the loops and the buckles being glued or made in a single piece with the first gloves and with the second glove, and are respectively made of an elastic fabric material or metal, plastic, carbon fiber, glass material or other suitable material for allowing the sliding of the flexible rod with a reduced friction value and each sheath is made of a metal, plastic, carbon fiber, glass material or other flexible material suitable for allowing the sliding of the flexible rods with a reduced friction value.

10. The rehabilitation device according to claim 1, further comprising power and/or strength sensors suitable for providing a feedback for activating the actuators and adjusting a movement according to the user's spontaneous joint responses during the rehabilitation session and measuring forces applied by the user during the exercise.

11. The rehabilitation device according to claim 1, further comprising a control and management software provided with a graphical interface for displaying simulations of the finger movements being made and sound and visual feedbacks associated with the finger movements.

* * * * *